US009085030B2

(12) United States Patent
Meyer et al.

(10) Patent No.: US 9,085,030 B2
(45) Date of Patent: Jul. 21, 2015

(54) HYBRID COMPONENT

(75) Inventors: Jonathan Meyer, Bristol (GB); Daniel Johns, Cullompton (GB)

(73) Assignee: AIRBUS OPERATIONS LIMITED, Bristol (GB)

( * ) Notice: Subject to any disclaimer, the term of this patent is extended or adjusted under 35 U.S.C. 154(b) by 588 days.

(21) Appl. No.: 13/262,694

(22) PCT Filed: Mar. 29, 2010

(86) PCT No.: PCT/GB2010/050527

§ 371 (c)(1),
(2), (4) Date: Dec. 12, 2011

(87) PCT Pub. No.: WO2010/112904

PCT Pub. Date: Oct. 7, 2010

(65) Prior Publication Data

US 2012/0099923 A1 Apr. 26, 2012

(30) Foreign Application Priority Data

Apr. 3, 2009 (GB) ..... 0905731.6

(51) Int. Cl.
*B22F 3/15* (2006.01)
*B22F 7/08* (2006.01)

(52) U.S. Cl.
CPC ... *B22F 3/15* (2013.01); *B22F 7/08* (2013.01); *B22F 2999/00* (2013.01); *Y10T 403/47* (2015.01)

(58) Field of Classification Search
USPC ..... 419/8
See application file for complete search history.

(56) References Cited

U.S. PATENT DOCUMENTS

| | | | | | |
|---|---|---|---|---|---|
| 2,490,548 | A | * | 12/1949 | Schultz | 29/898.058 |
| 3,940,268 | A | * | 2/1976 | Catlin | 419/8 |
| 4,063,939 | A | * | 12/1977 | Weaver et al. | 419/5 |
| 4,097,276 | A | * | 6/1978 | Six | 419/8 |
| 5,963,778 | A | | 10/1999 | Stellrecht | |

(Continued)

FOREIGN PATENT DOCUMENTS

| | | | |
|---|---|---|---|
| CN | 1684790 | A | 10/2005 |
| EP | 0507357A2 | A2 | 10/1992 |

(Continued)

OTHER PUBLICATIONS

State Intellectual Property Office of China Search Report for Application No. 201080015408.6, Mar. 29, 2010.

(Continued)

*Primary Examiner* — George Wyszomierski
*Assistant Examiner* — Ngoclan T Mai
(74) *Attorney, Agent, or Firm* — Lowe Hauptman & Ham, LLP

(57) ABSTRACT

A method of forming a hybrid component comprising at least two metallic parts, the method comprising preparing a first metallic part by forming at least one macroscopic interfacing feature on an interfacing surface of the part; positioning the first part in a mould tool; introducing a metallic powder into the mould tool and around the interfacing feature(s); and consolidating the metallic powder by a Hot-Isostatic Pressing (HIP) process to form a second metallic part which encapsulates the interfacing feature(s) to provide a mechanical connection between the first and second parts of the component. Also, a hybrid component so formed. The metallic parts may have substantially different material properties.

10 Claims, 4 Drawing Sheets

(56) References Cited

U.S. PATENT DOCUMENTS

| | | | | |
|---|---|---|---|---|
| 6,709,771 | B2 | 3/2004 | Allister | |
| 6,749,103 | B1 * | 6/2004 | Ivanov et al. | 228/115 |
| 6,939,508 | B2 | 9/2005 | Bampton et al. | |
| 7,667,158 | B2 | 2/2010 | Dance et al. | |
| 7,989,084 | B2 * | 8/2011 | Janecek | 428/548 |
| 2002/0122725 | A1 | 9/2002 | Daam et al. | |
| 2004/0081572 | A1 | 4/2004 | Bampton et al. | |
| 2008/0110835 | A1 | 5/2008 | Yoshida et al. | |

FOREIGN PATENT DOCUMENTS

| | | | |
|---|---|---|---|
| EP | 1106859 | A1 | 6/2001 |
| JP | 61-186405 | A | 8/1986 |
| JP | 62-033007 | A | 2/1987 |
| JP | 05-078709 | A | 3/1993 |
| JP | H06272507 | A | 9/1994 |
| JP | 2002322901 | A | 11/2002 |
| WO | 87/05241 | A1 | 9/1987 |
| WO | 03025244 | A2 | 3/2003 |
| WO | 2008110835 | A1 | 9/2008 |

OTHER PUBLICATIONS

State Intellectual Property Office of China Office Action for Application No. 201080015408.6 issued Feb. 27, 2013.

G. Le Marois et al., "Fusion reactor first wall fabrication techniques", Fusion Engineering and Design, Elsevier Science Publishers, Amsterdam, NL LNKD-DOI: 10.1016/S0920-3796(02)00222-3, vol. 61-62, Nov. 1, 2002, pp. 103-110, XP004397930, ISSN: 0920-3796, p. 109; figures 8-9.

Search Report of GB 0905731.6 dated Jun. 16, 2009.

International Search Report and Written Opinion of PCT/GB2010/050527 dated Jul. 28, 2010.

JP Application No. 2012-502782 Office Action dispatched Apr. 1, 2014.

Japanese Patent Application No. 2012-502782, Office Action dated Nov. 25, 2014.

* cited by examiner

HYBRID COMPONENT

RELATED APPLICATIONS

The present application is a National Phase of International Application Number PCT/GB 2010/050527, filed Mar. 29, 2010 and claims priority from, British Application Number 0905731.6, filed Apr. 3, 2009.

FIELD OF THE INVENTION

The present invention relates to a method of forming a hybrid component comprising at least two metallic parts, preferably with substantially different material properties. The invention also relates to the hybrid component so formed.

BACKGROUND OF THE INVENTION

Joining between metallic components is currently approached in a number of ways, each with its own limitations.

The use of fasteners is commonplace but leads to increased component weight due to the need for bolting flanges. Holes drilled to enable bolting also create stress concentrations which can act as crack initiation sites. As such, fastened joints are not well suited to many aerospace applications.

A common method of joining dissimilar metallic materials is by welding or brazing. However, these processes have their limitations. Welding can only be performed on certain materials and material combinations, and the welding process can introduce local heat affected zones which can be brittle and may adversely affect fatigue performance.

Adhesive joints between metallic parts are possible. However, their weakness in peel and in tension makes them limited in their suitability for use within conventional aerospace structures. Adhesives also tend to be sensitive to moisture and elevated temperatures, making them unsuitable for many applications.

WO 2008/110835 A1 describes a method by which surface projections are "grown" on a bond surface of a metallic component in a series of layers by an additive fabrication process. A pair of metallic components having complimentary surface projections may be brought together and bonded using a thin layer of adhesive. The complimentary projections improves the surface area of the bond.

SUMMARY OF THE INVENTION

A first aspect of the invention provides a method of forming a hybrid component comprising at least two metallic parts, the method comprising preparing a first metallic part by forming at least one macroscopic interfacing feature on an interfacing surface of the part; positioning the first part in a mould tool; introducing a metallic powder into the mould tool and around the interfacing feature(s); and consolidating the metallic powder by a Hot-Isostatic Pressing (HIP) process to form a second metallic part which encapsulates the interfacing feature(s) to provide a mechanical connection between the first and second parts of the component.

A further aspect of the invention provides a hybrid component comprising at least two metallic parts, wherein the first metallic part has at least one macroscopic interfacing feature formed on an interfacing surface of the part, and wherein the second metallic part has been formed by consolidating a metallic powder around the interfacing feature(s) by a Hot-Isostatic Pressing process to provide a mechanical connection between the first and second parts of the component.

The present invention is advantageous in that a hybrid component may be formed of at least two metallic parts. In this way, the first and second metallic parts may be formed of materials optimised for different purposes. For example, the material of the first part may be optimised for joining to a composite material, whilst the second metallic part may be formed of a material that is relatively less expensive. The HIP process is typically carried out at a high pressure in excess of around 100 MPa. Due to the high pressure used, the consolidation of the metallic powder around the interfacing feature(s) can create a fully dense hybrid component with little or no porosity or defects, even when the interfacing feature(s) have a complex shape. This is a particular benefit when compared with other forming processes, such as casting or Metal Injection Moulding, which could create some localised defects around the interfacing feature(s) and there would be some inherent porosity in the component due to these processes. In fact, hybrid components, where second part has been formed by casting, often undergo a HIP process after manufacture so as to close up the pores caused by the casting process. Therefore, the method of forming the hybrid component of this invention is advantageous in that the component can be formed in fewer steps.

The interfacing feature(s) are macroscopic. That is to say, they generally have a dimension of at least 1 mm. They are more than mere surface roughness and form a positive mechanical connection between the first and second parts. Preferably, the interfacing feature(s) have a dimension of at least 5 mm.

The interfacing feature(s) may be grown on the interfacing surface in a series of layers, each layer being grown by directing energy and/or material to the interfacing surface. Suitable additive manufacturing techniques which may be employed are a powder bed process or a powder feed process. Alternatively, the interfacing feature(s) may be formed by machining. The interfacing features may be an array of projections extending from the interfacing surface. Alternatively, the interfacing feature may be a tree-like projection having a plurality of branches. Yet further, the interfacing features may be a series or an array of recesses or grooves in the interfacing surface.

The first part having the interfacing feature(s) may be fixed in the mould tool and the metallic powder may be introduced as a flowable material to fill the mould tool and surround the interfacing feature(s).

The hybrid component may be a bracket component, comprising a bracket body (the second part) and an interfacing strip (the first part).

So that the interfacing features of the first part retain their integrity as the second part is formed around them, the material of the first part preferably has a higher melting point than the material of the second part. The material of the first part may have at least one of a higher Young's modulus, a higher corrosion resistance, or a higher toughness than the material of the second part.

Preferably, the first part has a second interfacing surface, and an array of projections are formed extending from the second interfacing surface for embedding in another component. The projections may be formed on the second interfacing surface either before or after the second part is formed. The other component may be a composite component, and is preferably a laminate composite component. The first and second interfacing surfaces may be on opposite faces of the first part such that the first part acts as an interfacing strip of the hybrid component.

BRIEF DESCRIPTION OF THE DRAWINGS

Embodiments of the invention will now be described with reference to the accompanying drawing, in which.

DETAILED DESCRIPTION OF EMBODIMENTS

Figure 1:
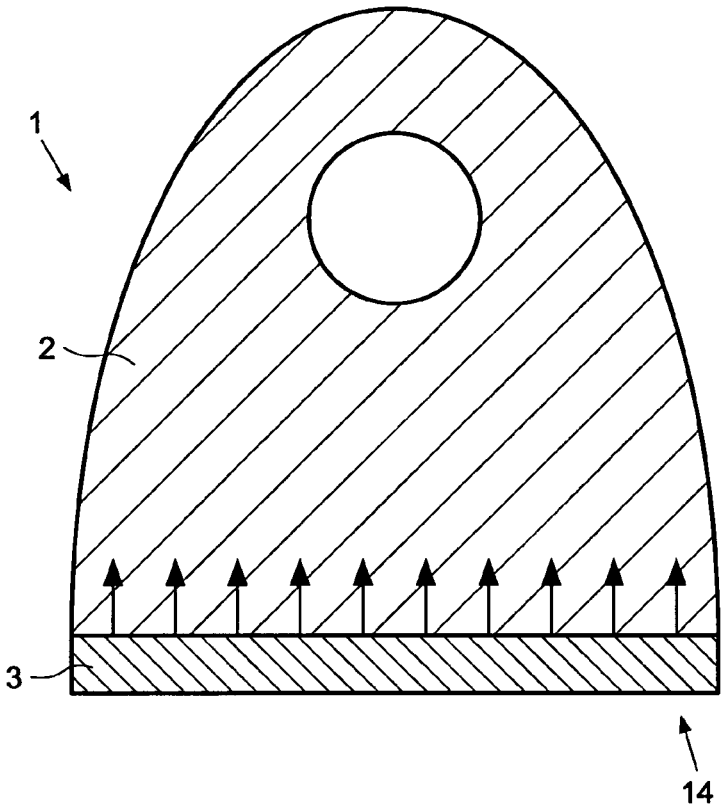
FIG. 1 illustrates a cross section view of a hybrid bracket component of a first embodiment, including a bracket body and an interfacing strip.

A hybrid bracket component 1 shown in FIG. 1 comprises a first metallic part and a second metallic part. The second metallic part forms a body 2 of the bracket component 1 and the first metallic part forms an interfacing strip 3.

Figure 2:
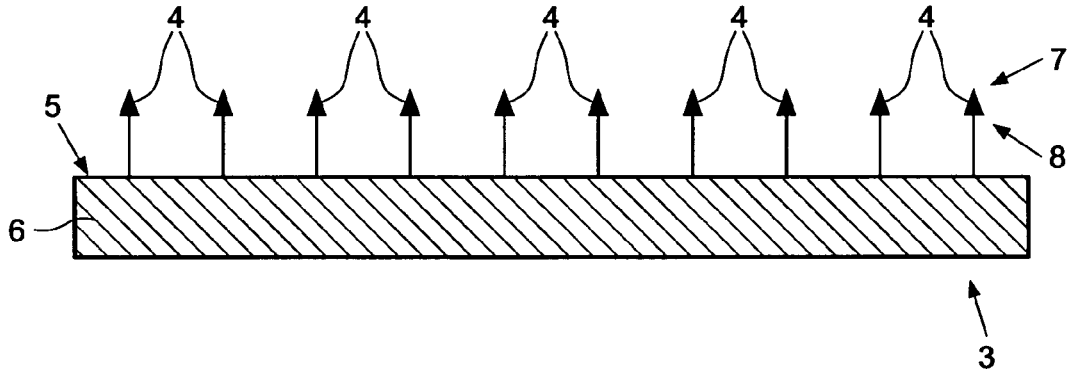
FIG. 2 illustrates a cross section view of the interfacing strip of the first embodiment.

A method of forming the hybrid bracket component 1 shown in FIG. 1 will now be described in detail. First, a three-dimensional array of macroscopic interfacing features 4 are formed on an interfacing surface 5 of a rectangular plate 6 to form the interfacing strip 3, shown in FIG. 2. The interfacing features 4 are an array of projections each having a pointed tip 7 and an overhang portion 8.

Figure 3:
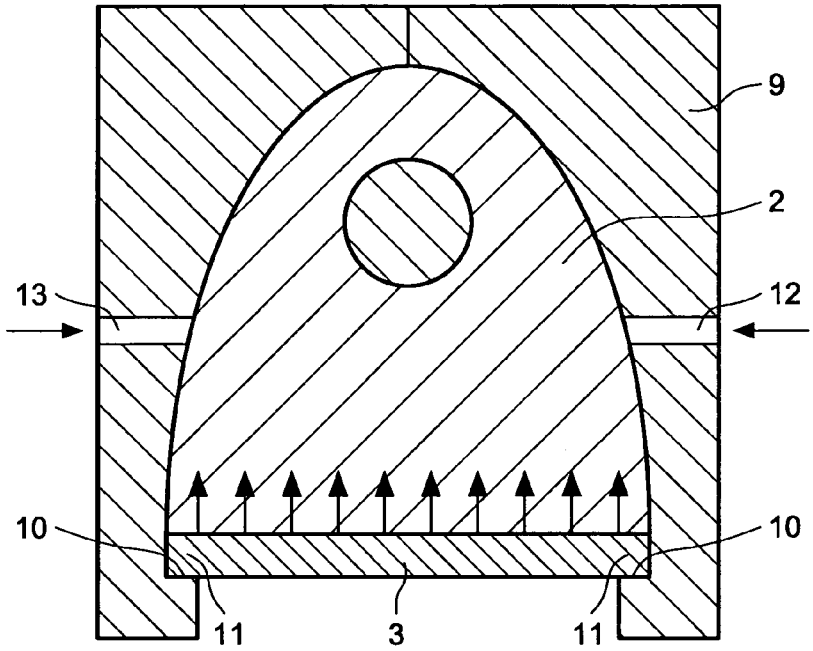
FIG. 3 illustrates a cross section view of formation of the hybrid bracket component of the first embodiment in a Hot-Isostatic Pressing mould tool.

The interfacing strip 3 having the interfacing features 4 is integrated into a two-part Hot-Isostatic Pressing mould tool 9 with the interfacing features 4 facing into the tool, as shown in FIG. 3. The mould tool 9 has a recess 10 which receives edges 11 of the interfacing strip 3. With the interfacing strip 3 in place, the mould tool 9 defines an interior volume which corresponds generally to the shape of the body 2 of the bracket component 1.

A metallic powder is introduced into the mould tool 9 to fill the interior volume via ports 12, 13. The metallic powder surrounds the interfacing features 4 of the interfacing strip 3. The assembly in the tool 9 is then subjected to Hot-Isostatic Pressing (HIP) at a temperature and pressure that will consolidate the metallic powder into a solid, fully-dense part—the body 2. This generates a mechanical connection between the two metallic parts 2, 3 to form the hybrid bracket component 1. The hybrid bracket 1 is then removed from the HIP mould tool 9.

The interfacing strip 3 is made of Titanium, such as Ti6A14V. The body 2 is made of Aluminium. The hybrid bracket 1 is a functionally graded part, having functionally graded materials across the component. The hybrid bracket 1 is advantageous in that one of its exposed faces 14 has improved corrosion resistance and toughness, whilst the bracket 1 overall remains lightweight and relatively inexpensive as it is predominantly made of Aluminium.

It is important that the material of the interfacing strip 3 has a higher melting point than the material of the body 2 such that the interfacing strip, in particular its interfacing features 4, retain their structural integrity as the body 2 is formed in the HIP process.

It will be apparent to those skilled in the art that the materials of the two metallic components may be altered to provide a functionally graded hybrid part suited to different applications. Furthermore, the hybrid component could include more than two metallic parts, with each additional metallic part being formed in a separate HIP mould tool. The material of the first metallic part may have at least one of a higher Young's modulus, a higher corrosion resistance, or a higher toughness than the material of the second metallic part.

As an alternative to forming the additional metallic parts by a HIP process, metal injection moulding, casting or other suitable processes may be alternatively employed.

The interfacing features 4 are grown sequentially on the interfacing surface 5 in a series of layers by an additive manufacturing process: either a powder bed process or a powder feed process such as described in WO 2008/110835 A1 (see col. 8-11). In the powder bed process a bed of metallic powder is rolled across a support member and a laser head scans over the powder bed directing a laser to selected parts of the powder bed. After a pause for the melted powder to solidify, another layer of powder is rolled over the previous layer in preparation for sintering. Thus as the process proceeds, a sintered part is constructed, supported by unconsolidated powder parts. After the part has been completed, it is removed from the support member and the unconsolidated powder is removed. The powder bed process can be used to form the entire metallic interfacing strip 3, including the plate 6 and the interfacing features 4.

The powder feed system can be used to build up the interfacing features 4 consecutively on a previously manufactured plate 6. The powder feed system can grow the interfacing features in series or parallel, whereas the powder bed system can only grow the interfacing features in parallel. In the powder feed system, un-sintered powder flows through a channel into a focus of a laser beam. As the powder is deposited, it melts to form a bead which becomes consolidated with existing material. Powder is only directed to selected parts of the interfacing surface 5, and the powder is fused as it is delivered. The laser source of either the powder bed or powder feed systems described in WO 2008/110835 A1 can be replaced by another power beam source, such as an electron beam source for directing an electron beam.

Alternatively, the interfacing features 4 can be generated by using a power-beam such as an electron beam, in order to 'flick-up' surface material from the interfacing surface 5 of the plate 6 to sculpt the features 4, using a process described in WO 2004/028731 A1.

The interfacing features 4 may also be formed by machining.

Figure 4:
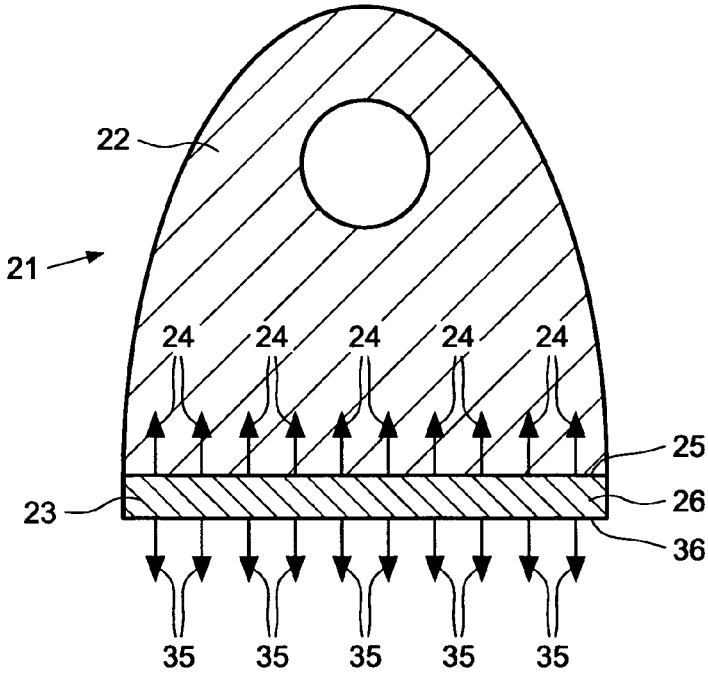
FIG. 4 illustrates a cross section view of a hybrid bracket component of a second embodiment, including a bracket body and an interfacing strip.
Figure 5:
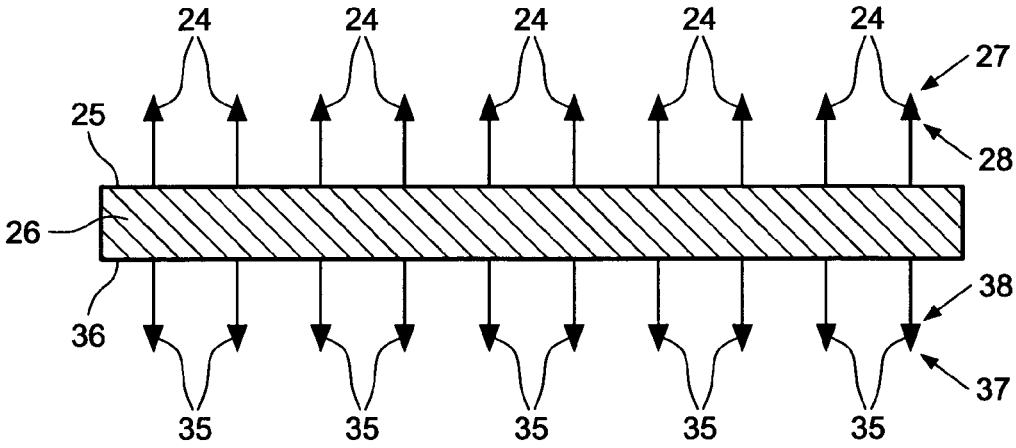
FIG. 5 illustrates a cross section view of the interfacing strip of the second embodiment.

A second embodiment of a hybrid bracket component 21 is shown in FIG. 4. The hybrid bracket 21 comprises a first metallic part and a second metallic part. The second metallic part forms a body 22 of the bracket component 21 and the first metallic part forms an interfacing strip 23.

The hybrid bracket 21 is similar to the hybrid bracket 1, with the exception that the interfacing strip 23 includes, in addition to an array of macroscopic interfacing features 24 on a first interfacing surface 25 of a rectangular plate 26, an array of projections 35 on a second interfacing surface 36, opposite the first interfacing surface 25.

A method of forming the hybrid bracket component 21 shown in FIG. 4 is similar to that described above in relation to the first embodiment, with the additional step of forming the array of projections 35 on the second interfacing surface 36. The interfacing features 24 are an array of projections each having a pointed tip 27 and an overhang portion 28. The projections 35 are oriented oppositely to the projections 24 and also each have a pointed tip 37 and an overhang portion 38.

The interfacing features 24 and the projections 35 are grown sequentially on the interfacing surfaces 25, 36 in a series of layers by one of the additive manufacturing processes described in WO 2008/110835 A1. Alternatively, they may be formed by the process described in WO 2004/028731 A1, or by machining. Depending on the method used to form the two sets of projections 24, 35, it may be necessary to flip the plate 26 after the first set of projections has been formed on one of the interfacing surfaces, so that the other set of projections may be formed on the other of the interfacing surfaces.

The body 22 is formed in a similar manner to that described above in relation to the first embodiment to form the hybrid bracket component 21 by consolidating a metallic powder in a HIP process around the interfacing features 24.

As an alternative to the above method, the hybrid bracket component 21 of the second embodiment may be formed by taking the hybrid bracket component 1 and forming the array of projections 35 on the exposed face 14 by any of the projection forming methods described above.

A Hybrid Penetrative Reinforcement (HYPER) joint may be formed by embedding the array of projections 35 of the bracket component 21 into a composite component, and then co-curing the components. Formation of a HYPER joint is described in detail in WO 2008/110835 A1 (see Cols. 7 and 8).

Figure 6:
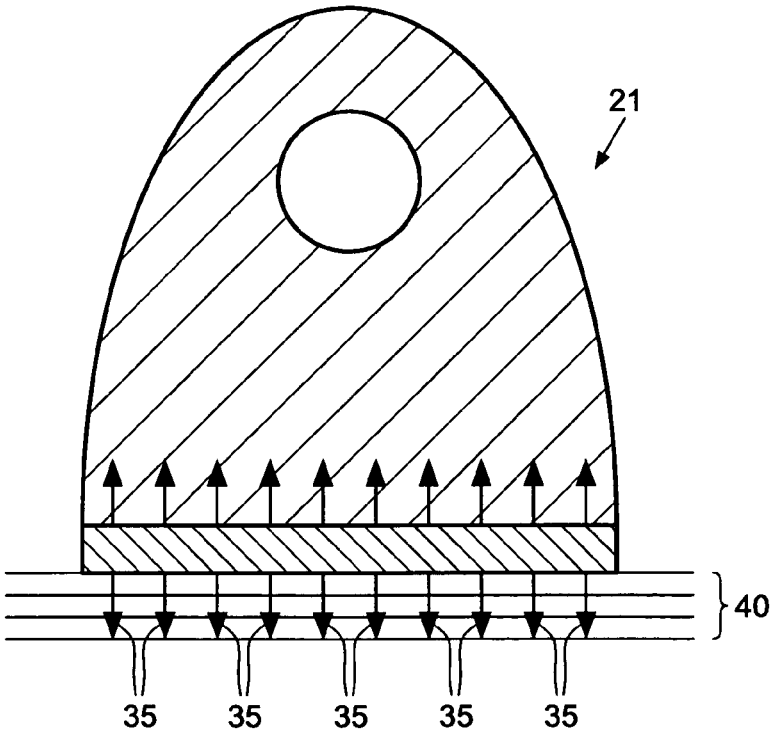
FIG. 6 illustrates a cross section view of the hybrid bracket component of the second embodiment joined to a composite component.

The bracket component 21 is integrated into a mould tool with the projections 25 facing outwardly and a composite lay-up is laid onto the mould tool. The composite lay-up comprises a series of plies of uni-axial carbon fibre, pre-impregnated with uncured epoxy resin. Each ply is conventionally known as a "prepreg". The initial prepregs are penetrated by the projections 35. After the lay-up has been formed, it is cured and consolidated by a so-called "vacuum bagging" process. That is, the lay-up is covered by a vacuum membrane (and optionally various other layers such as a breather layer or peel ply); the vacuum membrane is evacuated to apply consolidation pressure and extract moisture and volatiles; and the lay-up is heated (optionally in an autoclave) to cure the epoxy resin matrix. As the epoxy resin matrix melts prior to cure, it flows into intimate contact with the projections 35. The projections mechanically engage with the matrix, while also increasing the surface area of the bond. The resultant HYPER joint is shown in FIG. 6, with the bracket component 21 joined to a composite component 40 after removed from the mould tool. The joined components may then be assembled with various other components.

As an alternative to the method of forming a HYPER joint described above, the plies may be laid up on the mould tool as dry fibre plies, to which resin is subsequently infused and cured to form the composite component 40.

The profile of the projections may be optimised for embedding in the composite component. Each projection may have a conical tip, a frusto-conical base, and an inverted frusto-conical overhang. The overhang may have an undercut edge which is inclined and faces towards the second interfacing surface. The conical tip and the inverted frusto-conical overhang together form a "head" of each projection.

In the embodiments described above, the interfacing features are an array of projections each having a pointed tip and an overhang portion. However, it will be appreciated that the interfacing feature or features may take many different forms.

Figure 7:
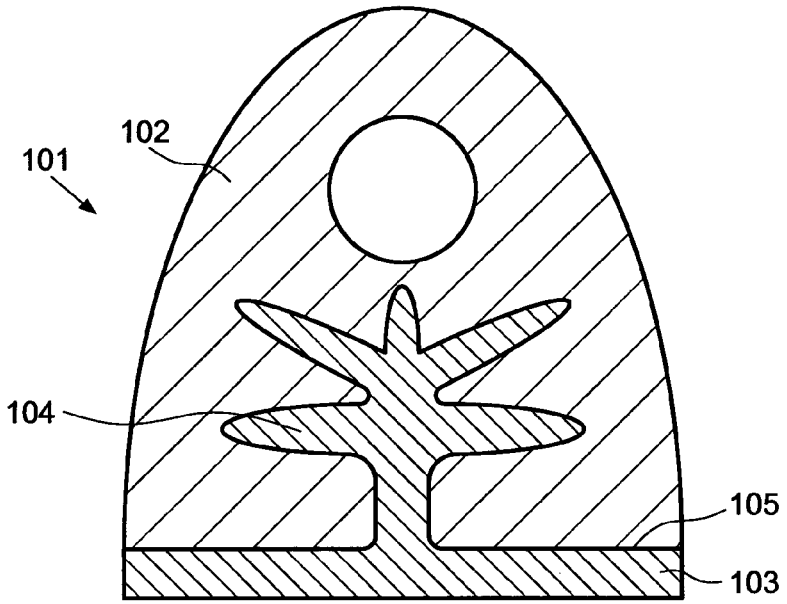
FIG. 7 illustrates a cross section view of a hybrid bracket component of a third embodiment, including a bracket body and an interfacing strip.
Figure 8:
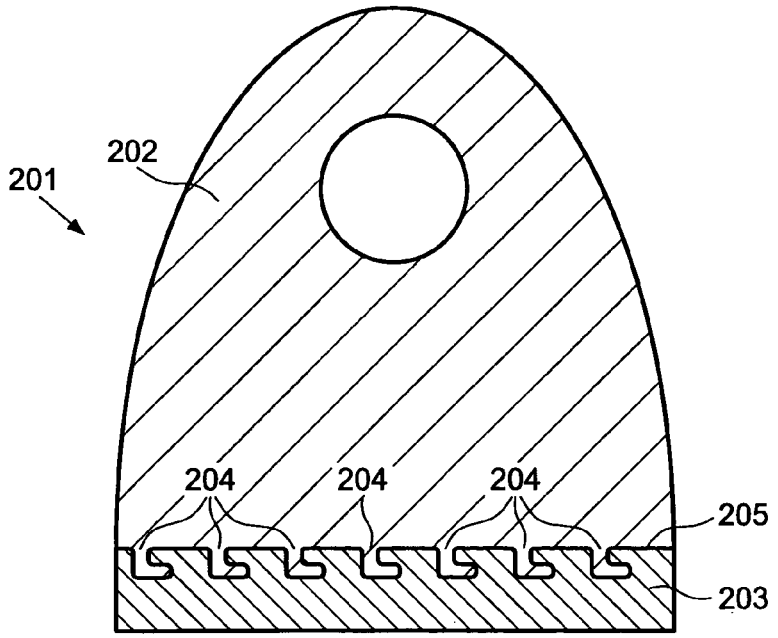
FIG. 8 illustrates a cross section view of a hybrid bracket component of a fourth embodiment, including a bracket body and an interfacing strip.

FIG. 7 illustrates a third embodiment of a hybrid bracket component 101 comprising a body 102 and an interfacing strip 103. The interfacing strip has a single interfacing feature 104 formed on its interfacing surface 105 and having a tree-like structure. FIG. 8 illustrates a fourth embodiment of a hybrid bracket component 201 comprising a body 202 and an interfacing strip 203. The interfacing strip has an array of interfacing features 204 formed as a series of grooves in its interfacing surface 205.

The interfacing feature(s) 104/204 of the embodiments shown in FIGS. 7 and 8 may be formed by, for example, one of the additive manufacturing processes, the surface sculpting process or the machining process described previously. The body 102/202 of the bracket component 101/201 may be formed by consolidating a metallic powder around the interfacing feature(s) 104/204 using the HIP processes described previously. Similar materials for the interfacing strip and the body may be used as before. The hybrid bracket components 101/201 may be joined to a composite component by forming a HYPER joint using the method described with reference to the second embodiment above.

Although the invention has been described above with reference to one or more preferred embodiments, it will be appreciated that various changes or modifications may be made without departing from the scope of the invention as defined in the appended claims.

The invention claimed is:

1. A method of joining a hybrid component to another component, the hybrid component comprising at least two metallic parts, the hybrid component being formed by a method comprising preparing a first metallic part by forming at least one macroscopic interfacing feature on an interfacing surface of the part; positioning the first part in a mould tool; introducing a metallic powder into the mould tool and around the interfacing feature(s); and consolidating the metallic powder by a Hot-Isostatic Pressing (HIP) process to form a second metallic part which encapsulates the interfacing feature(s) to provide a mechanical connection between the first and second parts of the component, the method of joining comprising forming an array of projections extending from a second interfacing surface of the first part of the hybrid component; and embedding the projections in the other component.

2. A method according to claim 1, wherein the interfacing feature(s) are grown on the interfacing surface in a series of layers, each layer being grown by directing energy and/or material to the interfacing surface.

3. A method according to claim 1, wherein the interfacing feature(s) are formed by machining.

4. A method according to claim 1, wherein the projections are formed on the second interfacing surface of the first part either before or after the second part is formed.

5. A method according to claim 1, wherein the interfacing feature(s) include a pointed tip.

6. A method according to claim 1, wherein the interfacing features are an array of projections extending from the interfacing surface.

7. A method according to claim 1, wherein the interfacing features are an array of recesses in the interfacing surface.

8. A method according to claim 1, wherein the interfacing feature is a tree-like projection having a plurality of branches.

9. A method according to claim 1, wherein the material of the first part has a higher melting point than the material of the second part.

10. A method according to claim 1, wherein the material of the first part has a higher Young's Modulus, or corrosion resistance, or toughness than the material of the second part.

* * * * *